United States Patent [19]

Castelli et al.

[11] 3,940,582

[45] Feb. 24, 1976

[54] MECHANICALLY OPERATED GAS BLAST CIRCUIT INTERRUPTER HAVING GASTIGHT ENCLOSURES

[75] Inventors: Cesar Castelli, Montfleury; Eugene Vincent, La Tronche, both of France

[73] Assignee: Merlin Gerin, Grenoble, France

[22] Filed: Jan. 28, 1974

[21] Appl. No.: 436,925

[30] Foreign Application Priority Data

Mar. 7, 1973 France ..... 73.08648

[52] U.S. Cl. ..... 200/148 B; 200/148 R

[51] Int. Cl.[2] ..... H01H 33/56

[58] Field of Search ..... 200/148 B, 148 R

[56] References Cited

UNITED STATES PATENTS 3,350,528 10/1967 McKeough ..... 200/148 B 3,374,331 3/1968 Brockhaus et al. ..... 200/148 B

*Primary Examiner*—Robert S. Macon

*Attorney, Agent, or Firm*—Stevens, Davis, Miller & Mosher

[57] ABSTRACT

Gas-blast circuit interrupter of the puffer type comprising sealed compressed-gas filled arc-extinguishing chambers and support insulators. The enclosures of the chambers and of the support insulator thereof are traversed by control rods which operate the contacts and which are assembled in situ through a door managed in a junction housing which secures the enclosures together and accomodates the confronting end portions of the rods. The junction housing is gastight and may be filled with the same gas as the enclosures so as to avoid pressure differentials across the seals causing leakage of gas. A fluid communication is established between the enclosures after mounting thereof on the junction housing.

7 Claims, 4 Drawing Figures

Fig. 1
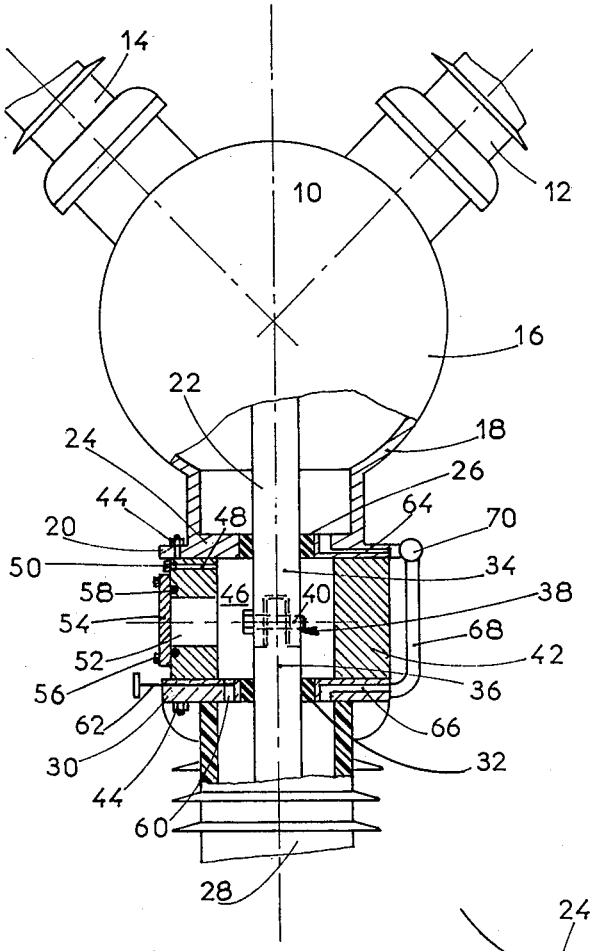
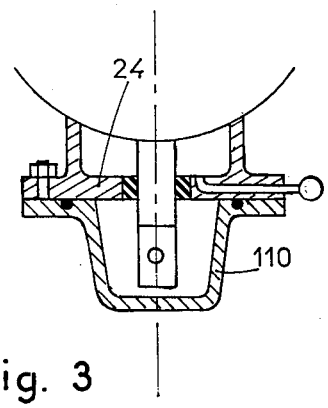
Fig. 3

MECHANICALLY OPERATED GAS BLAST CIRCUIT INTERRUPTER HAVING GASTIGHT ENCLOSURES

This invention relates to gas-blast puffer type circuit interrupters comprising one or more arc-extinguishing chambers the separable contacts of which are operated by a control rod traversing a seal mounted in the wall of each chamber.

Circuit interrupters of this kind are well known in medium, high and very-high voltages stations. The use of gases having a high arc-extinguishing and dielectric power, such as sulfur hexafluoride $SF_6$, makes it unnecessary to use double-pressure systems and systems in which the arc-extinguishing gas is exhausted to atmosphere at each interrupting operation, and thus with costly compressor stations in situ. The arc between the separating contacts, which are operated by a translational control rod, is quenched by a blast of gas generally produced by relatively movable piston and cylinder means constituting a puffer mechanism. In the following specification and claims the term "puffer-type" is to be understood as relating to compressed-gas circuit interrupters comprising sealed arc-extinguishing chambers in which an appropriate gas-blast mechanism directs a blast of arc-extinguishing gas to the arc during the circuit-opening operation.

The factory-sealed units of circuit interrupters of this kind, such as the arc-extinguishing chambers and the hollow supporting insulators, are shipped already filled with the often toxic compressed gas (that is gas under pressure above atmospheric pressure), and the units are assembled by the user. In conventional units, the dynamic seal of the translational control rod traversing the wall of a pressurized enclosure often causes leakage of gas bleeding through the differential-pressure seal so that provision must be made against the toxic effects of gas leaks thereby causing costly maintainance.

Collection of the leakage gas in a gastight vessel has been suggested but this provision does not do away with the problem of the leakage itself.

It is an object of the invention to provide a puffer-type circuit interrupter in which the leakage through the sealing parts of the pressurized enclosure is largely prevented and under any case completely harmless in normal service conditions.

It is a related object of the invention to provide a circuit interrupter which is very simple to assemble by the final user under increased security conditions without needing a filling of the enclosures in situ with the compressed gas.

These and other objects and advantages will become apparent upon reading of the following description of some embodiments of the invention, given by way of examples only and shown in the annexed drawings, in which:

FIG. 1 is a diagrammatic view, partially in section, of a part of a circuit interrupter according to the invention;

FIG. 3 is a sectional view showing a protection cap for a disassembled element.

In the different FIGURES, identical reference numerals designate like elements.

Figure 2:
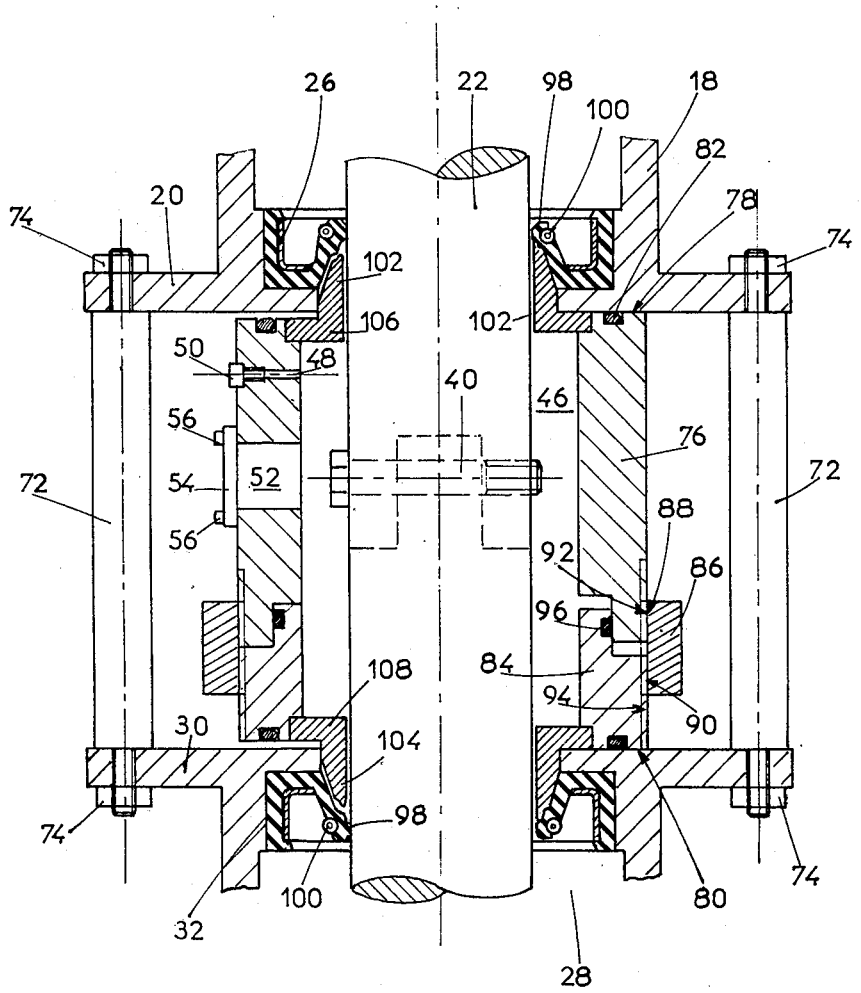
FIG. 2 is a fragmentary sectional view at an enlarged scale of another embodiment, the left part of the FIGURE showing the coupling sleeve in retracted position, and the right half representing the sleeve in extended working position.

Referring now to FIGS. 1 and 2, there is shown a circuit interrupter unit 10 comprising two arc extinguishing units 12, 14 which are only partially shown in FIG. 1 and which are of the well-known puffer-type comprising separable contact means (not shown) and for example a piston-and-cylinder puffer mechanism (not shown) drivingly connected to the movable contact. An extension 16 of the enclosure of the arc-extinguishing chambers is equipped with a projection 18 having a connection flange 20. The unit 10 constitutes a sealed off unit filled with a compressed arc-extinguishing gas under a pressure above atmospheric pressure, such as sulfur hexafluoride $SF_6$, whereby a translational control rod 22 traverses the bottom 24 of the projection 18 through a seal 26 to permit operation of the chambers 12, 14, generally through actuation of the movable contacts without affecting the gas tightness of the unit.

In conventional manner, the unit 10 is supported an adequate distance from ground potential (generally, from ground) by a hollow supporting insulator 28 of which only the upper part is shown in FIG. 1. The insulator is closed at both ends thereof by gastight wall members the upper wall member being arranged as a connection flange 30 traversed by the control rod slidably mounted in a seal which is identical to the seal 26. The control rod 22 is subdivided into two parts, the upper part 34 being associated with the unit 10 and the lower part 36 extending through the entire length of the insulator 28 to permit the actuation of the contacts of the chambers 12 and 14 from a control post (not shown) disposed at ground potential at the lower end (not shown) of the insulator 28. The confronting end portions of the control rods 34 and 36 are coupled through a tongue and groove joint 38 assembled by means of a pin 40. The gastight supporting insulator 28 is filled with the same gas under a pressure above atmospheric pressure as the enclosure of the unit 10 (for example $SF_6$). The insulator 28 is supplied factory-sealed, as is the unit 10.

The enclosures of the units 10 and 28 are assembled in situ by insertion of a sleeve or junction housing 42 of cylindrical or polygonal shape, for example, duly fastened to the flanges 20, 30, respectively, by means of stud bolts and nuts 44. The housing 42 secures the unit 10 rigidly and mechanically to the insulator 28 in a gastight manner and defines an inner volume 46 accomodating the confronting coupling end portions of the control rods 34, 36. An exhaust conduit 48 which may be closed by a plug 50, traverses the wall of the upper part of the sleeve 42. The latter comprises a relatively large lateral opening 52 giving ready access to the coupling pin 40 to permit the mounting and removal thereof in assembled position of the units 10, 42 and 28, thereby permitting the coupling and uncoupling of the rods 24 and 36. The opening 52 can be closed in a gastight manner by a door 54 which is fastened through stud bolts and nuts 56 with interposition of a sealing joint 58.

The flange 30 presents an aperture 60 which permits free fluid communication between the inside of the gastight enclosure of the insulator 28 and the volume 46 within the sleeve 42 whereby a valve 62 permits closing of the conduit 60. Conduits 64, 66 traverse the flanges 20, 30, respectively, and communicate in a gastight manner through a pipe 68 associated with a coupler 70. In assembled position, the inside of the enclosures of the unit 10 and of the insulator 28 communicate through the conduits 64, 66 and the pipe 68 equipped with the coupler 70. The latter is of the self-closing type ensuring in a well-known manner the automatic closing of the conduits 64, 66 in uncoupled position of the coupler 70.

The circuit interrupter is assembled in the following manner:

The factory-pressurized and factory-sealed unit 10 and insulator 28 are secured together by the user through the housing 42 which is fastened by means of the bolts and nuts 44. The door 54 is removed and the coupling pin 40 installed after due engagement of the tongue and groove joint of the confronting end portions of control rods 34, 36 which are then ready to operate the arc-extinguishing chambers 12 and 14 from the ground level. The door 54 is hermetically closed and the plug 50 removed. The air contained in the volume 46 is swept away by the entry into the volume 46 of compressed gas ($SF_6$) from the inside of the insulator 28 through the aperture 60 upon opening of the valve 62. The density of the sulfur hexafluoride gas being higher than the density of air, the latter is readily driven upwardly whereupon it can exhaust through the conduit 48. The complete clearing of the volume 46 is detected by the finding of sulfur hexafluoride gas at the outlet of conduit 48 which is then closed by the plug 50. The coupler 70 is installed to cause free fluid communication between the inside of the enclosures of unit 10 and insulator 28. It will be seen that the volume 46 and the inside of the enclosures of the unit 10 and of the insulator 28 are all filled with $SF_6$ at the same pressure and communicate through the conduit 60 and the pipe 68. Because of the absence of any pressure differential, a fault in the sealing of seals 26, 32 is without any consequence and entry of air is excluded.

The connection device permits of course the disassembling of the unit 10 without loss of the pressure in the insulator 28 and in the unit 10. It suffices thereto to uncouple the coupler 70 and to close the valve 62 in order to isolate the gastight enclosures of the unit 10 and of the insulator 28.

During the removal of the door 54, the sulfur hexafluoride of the volume 46 exhausts to atmosphere but the quantity of lost gas is relatively small and harmless. The subsequent removal of the coupling pin 40 permits the disengagement of the control rods 34, 36 and the unfastening of the nuts 44 causes the unmounting of the unit 10 which, as the case may be, can be replaced by a stock unit.

FIG. 2 shows an embodiment in which certain apertures and conduits arranged in the fastening flanges are left out. The connection between the unit 10 and the supporting insulator 28 is ensured by the rods 72 which are fastened to the flanges 20, 30 by nuts 74. In mounted position of the pole, the portion of the control rod 22 extending between the flanges 20 and 30 is surrounded by a sleeve 76, which may be of cylindrical shape, and the front parts 78, 80 in which are inserted sealing joints 82, here against the flanges 20 and 30 in order to define a gastight volume 46. As in the FIG. 1 embodiment, the sleeve 76 comprises a door 54 and a draining aperture 48. The sleeve 76 has a telescopic portion 84, the extension and contraction movement of which is controlled by a screw ring 86 having a right-handed and a left-handed thread 88, 90 threadably engaging corresponding threads 92, 94, respectively, on the outer surface of the upper part 76 and the lower part 84 of the sleeve so that rotation of the ring 86 in one sense or the other causes the telescopic portion of the sleeve to extend or contract, respectively. A joint 96 ensures the sealing between the telescopically engaging parts.

The sealing joints 26 and 32 sealing the control rod 22 where the latter traverses the wall of unit 10 and of insulator 28, respectively, are of the lip type, whereby the lips 98 are maintained against the rod 22 by resilient rings 100. The gas-tightness of the joints 26, 32 may be broken by deflecting the lips 98 under the action of the wedging of the chamfered edges 102, 104, respectively, of rings 108, 106, respectively, which are carried by the end portions 78, 80, respectively, of the sleeve 76 and moved by turning of the ring 86.

This device operates as follows:

The sleeve 76 being in the contracted position thereof (see left part of FIG. 2), the unit 10 is positioned on the insulator 28 with interposition of the sleeve 76. The rods are connected by insertion of the coupling pin 40 through the opening 52 and the door 54 is closed and fastened by means of the nuts 56. The sealing joints 26, 32 are still sealing off the inside of the enclosures 10 and 28 from the volume 46 within the sleeve 76. A rotation of the ring 86 in the desired direction causes the sleeve to lengthen telescopically so as to take the position represented in the right half of FIG. 2, wherein the front edges bear against the flanges 20, 30 ensuring thereby the sealing of the volume 46. The lengthening of the telescopic sleeve 76 causes the axial movement of the ring members 106, 108 which lift the lips 98 from the rod 22 by the wedging action of the portions 102, 104 causing thereby free communication of the inside of the enclosures 10 and 28 with the volume 46. The air in volume 46 is exhausted through conduit 48 after removal of the plug 50. The different parts are preferably so arranged that the sealing of joint 32 is broken before the sealing of joint 26, taking advantage of the relative high density of the $SF_6$ gas. In this case, after breaking of the seal 32, the continued turning of the ring 86 after plugging of the conduit 48 causes the breaking of the other joint 26. In the final position the three volumes are at the same pressure. The communication pipe 70 is thus superfluous. On the other hand, in the working position the lips 98 of the joints 26, 32 are withdrawn from the rod 22 and are thus preserved from wearing. After an eventual disassembling of the sleeve 76, the joints 26, 32 ensure again their sealing action.

Of course, the mechanical details of the embodiment shown in FIG. 2 are largely diagrammatically represented, more particularly in connection with the telescopic portion of sleeve 76 and the sealing front parts thereof. Preferably, the sealing action of the latter should begin before breaking of the sealing action of the seals 26, 32 in order to prevent the gas from leaking away.

The joints 26, 32 ensure the sealing of the units 10 and of the insulators 28 during the transport and storage thereof. In order to avoid any accidental loss or leakage of the gas, it may be useful to double the sealing, for instance by a protection cap 110 (FIG. 3) covering the end portions of the control rod 22 and hermetically connected to the flange 24 (in the case of unit 10).

Figure 4:
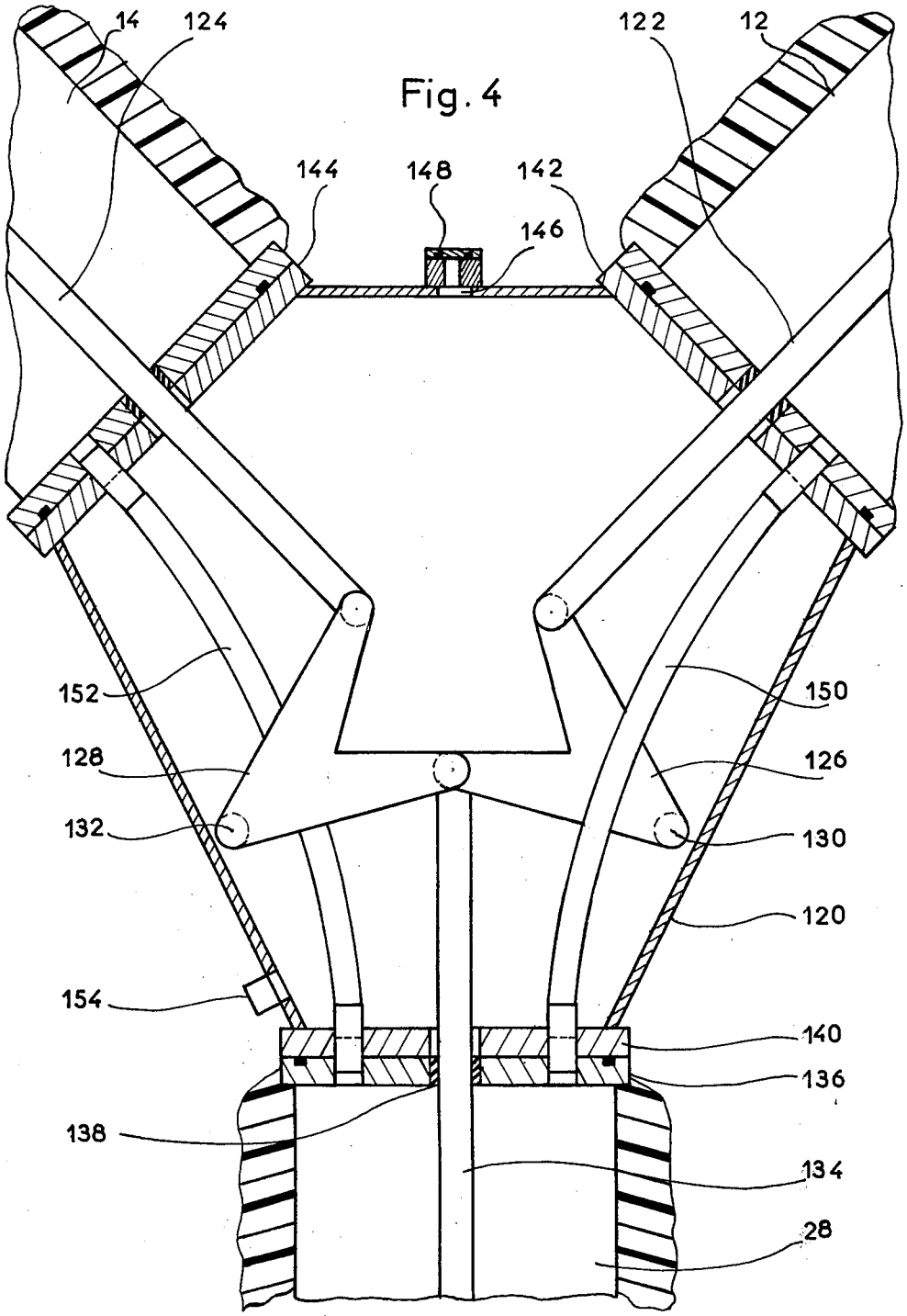
FIG. 4 is a diagrammatic view, partially in section, of another embodiment.

In the embodiment shown in FIG. 4, a hollow supporting insulator 28 carries at the upper end thereof through a gastight housing 120 two arc-extinguishing chambers 12, 14 disposed in a well-known generally V-shaped manner. Each arc-extinguishing chamber 12 and 14 comprises a sealed gastight enclosure filled with sulfur hexafluoride gas and having its own control rod 122, 124, respectively, traversing the wall of the enclosure through sliding sealing joints. The end portions of the control rods 122, 124 are pivotally connected to bell cranks 126, 128, respectively, which are in turn pivotally connected to fixed axes 130, 132, respectively, and which have a common pivot connection to a common control rod 138 extending through the inside of the insulator 28. Again, the latter is filled with pressurized $SF_6$ gas and the upper end of the insulator is closed by a cover 136 shaped as a fastening flange which is traversed by the control rod 134 cooperating with a seal 138. The gastight housing 120 has three fastening flanges 140, 142 and 144 which are rigidly secured in a gastight manner to the cover 136 and to the bottom flanges of the arc-extinguishing chambers 12 and 14, respectively. A draining opening closed by a plug 148 is provided at the uppermost part of the housing 120 and flexible conduits 150, 152 extend within the housing 120 to establish a free fluid communication between the inside of the arc-extinguishing chambers 12, 14 and of the insulator 28. The flexible conduits 150, 152 are connected to the gastight enclosures by means of self-checking coupling devices, which may be of the well-known spring-loaded ball type ensuring the automatic sealing of the enclosures upon withdrawal of the flexible conduit. A window (not shown in FIG. 4) is provided in the housing 120 opposite the cranks 126 and 128 and a closable filling orifice 154 at the lower part of the housing permits the filling thereof with the sulfur hexafluoride gas.

This connection device is assembled in the following manner:

The factory-filled and -sealed units 12, 14 are mounted on top of the insulator 28 by means of the casing 120. The coupling pins of the different control rods to the bell cranks 126, 128 are inserted through the window in the wall of the casing 120 after which the flexible conduits 150 and 152 are installed to establish the desired fluid communication between the inside of the units 12, 14 and of the insulator 28. The window is then hermetically closed and the plug 148 withdrawn. The air in housing 120 is exhausted by introducing $SF_6$ through stud 154. Care is taken in order that the pressure in the housing 120 be substantially the same as the pressure existing in the interconnected units 12, 14 and 28 so as to avoid any pressure differential across the seals surrounding the control rods. In this way, as before, a sealing failure of the seals remains without any consequence.

During the disassembling of the device, the window is opened to exhaust the $SF_6$ gas from the housing 120. The flexible conduits 150 and 152 and the coupling pins are withdrawn from the units 12, 14 and 28 so that it becomes possible to exchange the units, as desired.

What is claimed is:

1. A gastight gas-blast circuit interrupter of the puffer-type comprising:

at least one arc-extinguishing chamber having a gastight separable contact means containing enclosure filled with an arc-extinguishing gas under a pressure above atmospheric pressure, a seal in the wall of said enclosure, and a movable contact-operating rod traversing said wall in a gastight manner through said seal;

hollow insulating support means to support said chamber an appropriate distance from ground potential and having a gastight enclosure containing the same gas under a pressure above atmospheric pressure as the enclosure of said chamber, a seal in the wall of said enclosure of said support means, and a movable control rod traversing said wall of said enclosure of said support means in a gastight manner through the seal thereof, said contact-operating rod and said control rod having confronting end portions extending externally of said enclosures and adapted to be coupled together in motion-transmitting relation to permit operation of said contact-operating rod by actuation of said control rod;

a gastight hollow junction housing joining said enclosures and accommodating said end portions, said seals being disposed in the partition wall portions common to said housing and to said enclosures, respectively, said housing having removable wall means permitting the coupling and uncoupling of said end portions therethrough from the outside of said housing, and means for filling said housing with said gas under a pressure above atmospheric pressure.

2. A circuit interrupter according to claim 1, further comprising fluid communication means establishing a free fluid communication between said enclosures.

3. A circuit interrupter according to claim 2, wherein the pressure in said housing is substantially equal to the pressure existing in said enclosures.

4. A circuit interrupter according to claim 2, wherein said fluid communication means comprises self-closing check means automatically sealing off said enclosures upon removal of said fluid communication means.

5. A circuit interrupter according to claim 4, wherein said fluid communication means extends through said housing.

6. A circuit interrupter according to claim 4, wherein said fluid communication means comprises flexible conduit means extending through said housing in gastight relation therewith.

7. A circuit interrupter according to claim 1, wherein said housing comprises means to release said seals upon mounting of said housing between said enclosures thereby establishing a free fluid communication between said enclosures through the inside of said housing.

* * * * *